US007559159B1

(12) United States Patent
Lundberg

(10) Patent No.: US 7,559,159 B1
(45) Date of Patent: Jul. 14, 2009

(54) SOLEMAT

(76) Inventor: Gwendolyn E. Lundberg, 2009 McGilvra Blvd. East, Seattle, WA (US) 98112

( * ) Notice: Subject to any disclaimer, the term of this patent is extended or adjusted under 35 U.S.C. 154(b) by 347 days.

(21) Appl. No.: 11/032,857

(22) Filed: Jan. 10, 2005

Related U.S. Application Data

(60) Provisional application No. 60/535,349, filed on Jan. 9, 2004.

(51) Int. Cl.
*A43B 13/22* (2006.01)

(52) U.S. Cl. ..... 36/73; 36/7.1 R

(58) Field of Classification Search ..... 36/73, 36/15, 9 R, 9 A, 7.1 R, 72 R; 428/40.1; 206/447, 206/813
See application file for complete search history.

(56) References Cited

U.S. PATENT DOCUMENTS

| | | | | | |
|---|---|---|---|---|---|
| 1,843,687 | A | * | 2/1932 | Lovell | 36/77 M |
| 1,942,287 | A | * | 1/1934 | Heitz | 206/447 |
| 1,980,621 | A | | 11/1934 | Innis | |
| 2,248,317 | A | * | 7/1941 | Van Cleef | 206/447 |
| 2,408,152 | A | | 9/1946 | Porcelli | |
| 2,647,848 | A | * | 8/1953 | Douglas et al. | 206/447 |
| 2,768,902 | A | * | 10/1956 | Scholl | 156/254 |
| 2,943,403 | A | | 7/1960 | Meister | |
| 2,985,970 | A | | 5/1961 | McCarthy | |
| 3,353,666 | A | * | 11/1967 | Jensen | 206/447 |
| 3,501,797 | A | * | 3/1970 | Nappi | 15/215 |
| 3,509,991 | A | * | 5/1970 | Hurst | 428/322.7 |
| 3,693,269 | A | * | 9/1972 | Guarrera | 36/15 |
| 3,694,939 | A | * | 10/1972 | Chen | 36/7.3 |
| 3,903,620 | A | | 9/1975 | Gillet | |
| 4,304,021 | A | * | 12/1981 | Theodorsen | 12/142 R |
| 4,335,527 | A | * | 6/1982 | Pask | 36/7.1 R |
| 4,650,706 | A | * | 3/1987 | Emmel | 428/40.1 |
| 4,713,274 | A | * | 12/1987 | Minor | 428/40.1 |
| 4,837,062 | A | * | 6/1989 | Dunshee et al. | 428/41.3 |
| 4,842,919 | A | * | 6/1989 | David et al. | 428/42.1 |
| 5,020,185 | A | * | 6/1991 | Hoefler | 15/257.1 |
| 5,771,605 | A | | 6/1998 | Safdie | |
| 5,907,881 | A | | 6/1999 | Safdie | |
| 6,458,442 | B1 | * | 10/2002 | McKay | 428/40.1 |
| 6,584,704 | B2 | | 7/2003 | March | |
| 6,640,465 | B1 | | 11/2003 | Burgess | |
| 6,684,442 | B1 | * | 2/2004 | Parker et al. | 12/146 B |
| 2002/0023371 | A1 | * | 2/2002 | Gultekin et al. | 36/7.1 R |
| 2006/0037214 | A1 | * | 2/2006 | Goggin-Lewis | 36/11.5 |

* cited by examiner

*Primary Examiner*—Marie Patterson
(74) *Attorney, Agent, or Firm*—Christensen O'Connor Johnson Kindness PLLC

(57) ABSTRACT

A sole protector tablet (6) includes a plurality of sole protectors (11) nominally stacked on top of each other, where each sole protector (1) has a ground touching surface (3) and a foot touching surface (4). The tablet also includes means for securing one sole protector (1) to at least one other sole protector (1), such that the foot touching surface (4) of the first top sole protector (9) engages the ground touching surface (3) of the second sole protector (10) beneath it.

20 Claims, 4 Drawing Sheets

SOLEMAT

CROSS-REFERENCE TO RELATED APPLICATION

This application claims the benefit of U.S. Provisional Application No. 60/535,349, filed Jan. 9, 2004, the disclosure of which is hereby expressly incorporated by reference, and priority from the filing date of which is hereby claimed under 35 U.S.C. §119(e).

FIELD OF THE INVENTION

The present invention relates generally to a disposable, self-adhesive foot and sole protector, wherein a plurality of sole protectors are secured together in a tablet form for convenient distribution.

BACKGROUND OF THE INVENTION

There are many situations that require a person to be without shoes or socks. For instance, a person may be required to remove his or her shoes when walking through a security checkpoint at an airport, when walking around a medical clinic, or when walking throughout a public locker room. In those situations, a person's foot may become soiled if the person does not have an extra pair of socks or protective shoes. In addition, there are many situations where a walking surface must be protected from a soiled or wet shoe. For instance, homeowners may wish to protect their floor at an open house event, and a car dealership may want to protect the floor of a new automobile during a test drive. It is normally unacceptable in these situations to request that a person remove their shoes; accordingly, the floors may become dirty.

Based on the foregoing, there is a need to temporarily protect the sole of the foot or shoe in certain situations. Moreover, there is a need for temporary protection that is sufficiently low-cost and easy to apply to a foot or shoe to ensure that the effort expended in taking such protective measures does not outweigh the benefits of such protection. In addition, it is preferable that the sole protector be disposable so as to prevent unnecessary accumulation of used sole protectors in a home or a place of business. Accordingly, there is a need for a low-cost sole protector that is conveniently dispensed, for example, from a tablet, for quick and easy access, that is also disposable and low in cost.

SUMMARY OF THE INVENTION

One embodiment formed in accordance with the present invention includes a sole protector tablet that includes a plurality of sole protectors nominally stacked on top of each other, where each sole protector has a ground touching surface, a foot touching surface, a sole portion, and a heel portion. The tablet also includes means for securing one sole protector to at least one other sole protector, such that the foot touching surface of the first top sole protector engages the ground touching surface of the second sole protector beneath it.

The sole protectors may be secured together by one of several available methods. Ideally, each sole protector adheres to the one beneath it to form a stack of sole protectors. To dispense a sole protector, the top sole protector may be simply peeled away from the sole protector beneath it. Alternatively, the plurality of sole protectors may be secured to one another through a tablet edge. In this embodiment, a peel sheet may be employed so that the plurality of sole protectors do not adhere to one another. Thus, to dispense a sole protector for use, the sole protector may be torn away from the tablet edge and the peel sheet may then be removed. In yet another embodiment of the tablet, the plurality of sole protectors may be secured by a binding tablet edge. In this embodiment, peel sheets may be used to prevent one sole protector from adhering to another sole protector. The edge of the sole protector may be perforated so that the sole protector can be torn away from the binding edge. As an alternative, a low tack adhesive may be used so that the top sole protector can be readily peeled from the sheet below at the same time the protector is torn away from the binding edge.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
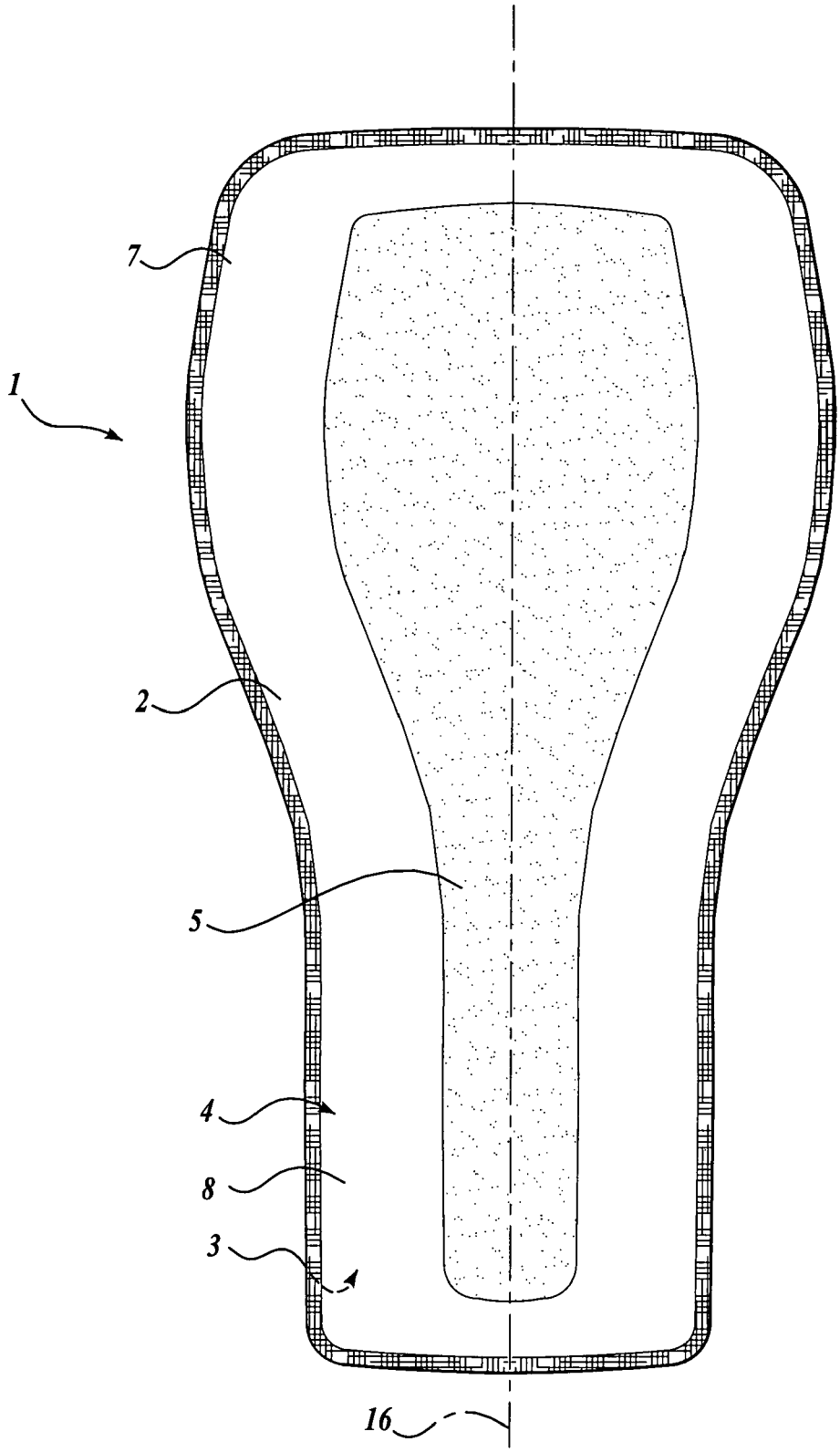
FIG. 1 is a top view of the sole protector tablet.
Figure 2:
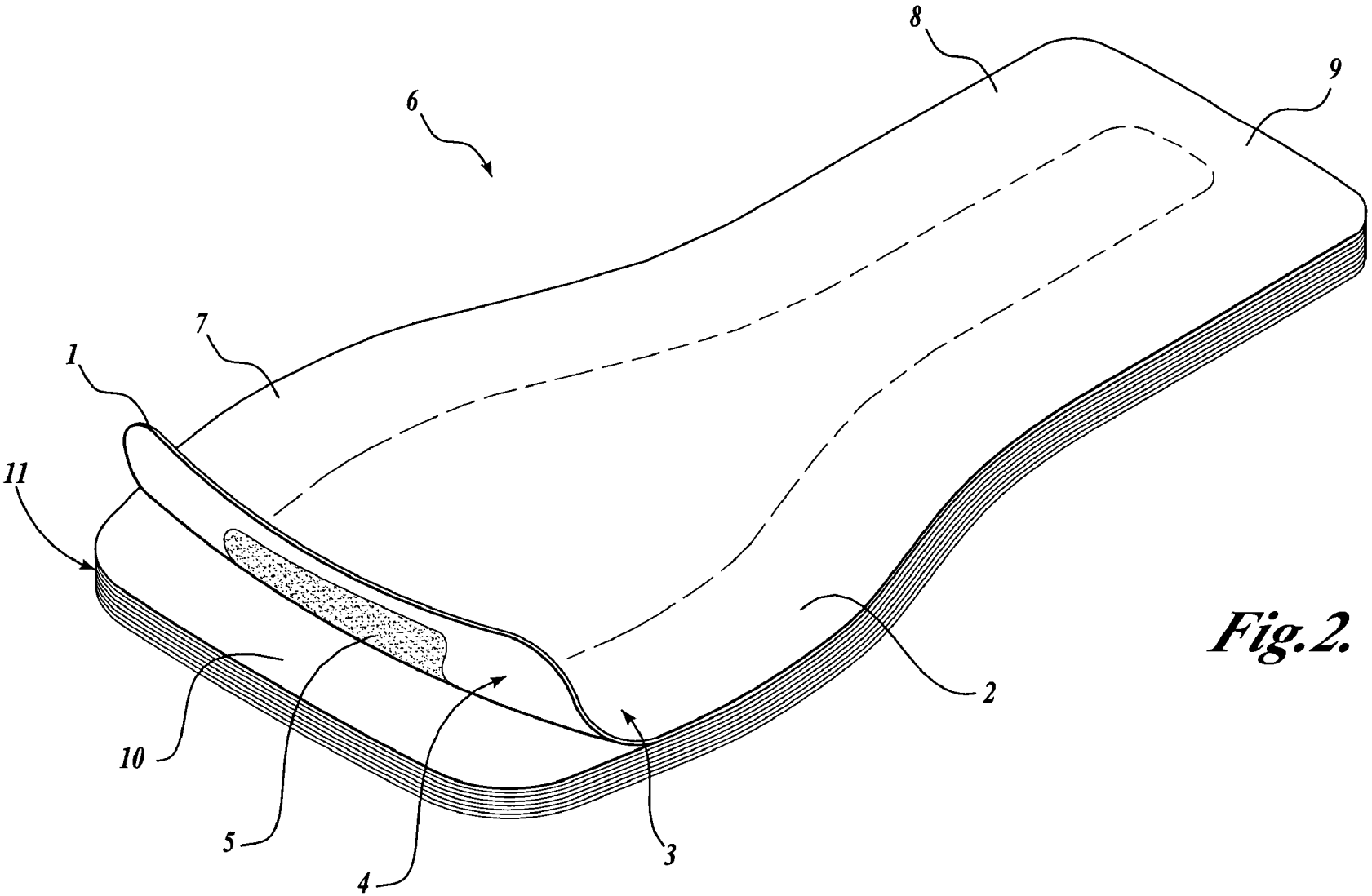
FIG. 2 is a perspective view of one embodiment of the tablet.

Referring to FIGS. 1 and 2, the present invention concerns a sole and foot protector 1 that dispenses on a tablet 6. More particularly, each sole protector 1 may be a paper or fabric sheet product, of a selected thickness and size, that is shaped to attach to the bottom of a bare foot, a stocking, or the sole of a shoe or other footwear through the use of a low tack adhesive. The sole protector is designed to be inexpensive, disposable, nontoxic, and biodegradable.

Still referring to FIGS. 1 and 2, a disposable, self-adhesive foot and sole protector 1 is shown. FIG. 1 shows a top view of a single sole protector 1. Each sole protector 1 consists of a base member 2 that may be made of a thin sheet material, such as paper, fabric, plastic, or an equivalent material. Moreover, the base member 2 material may be water resistant, biodegradable, available in a variety of colors, and may have printing and graphics imprinted thereon, which may constitute advertising.

The sole protector 1 has a shape such that it may adhere to both a right and a left foot. More specifically, the sole protector 1 may generally take the shape of a left foot superimposed upon a right foot. To ensure that the sole protector fits both a right and left foot, the sole protector 1 may be symmetrical about a center longitudinal axis 16. In addition, the base member may have a wider toe portion 7 and a narrower heel portion 8, wherein the toe portion 7 may be substantially the same shape as a left sole of a foot superimposed upon a right sole of a foot, and the heel portion 8 may have the general shape of a left heel of a foot superimposed upon a right heel of a foot. Accordingly, the sole protector 1 may be universal to both the right and left foot. In this manner, the sole protector is somewhat contoured to the shape of a human foot. However, this need not be the case. Instead, the sole protector can be of rectangular shape. Also, the sole protector 1 may be available in a variety of sizes, such as small, medium, and large. Although it is preferable that the sole protector 1 be universal to both the right and left foot, it may also be shaped to fit only a left or right foot.

The base member 2 has a ground touching surface 3 and a foot touching surface 4. The ground touching surface 3 may act as a non-skid surface. Thus, the ground touching surface 3 may include a thin layer of rubber or similar material that will create a non-slip or reduced-slip surface. Alternatively, the ground touching surface may be rough, or at least not smooth, to reduce the possibility of the user slipping when using the present invention. The foot touching surface 4 temporarily adheres to the bottom of a foot, shoe, or other footwear. To enable the attachment, a temporary, pressure sensitive adhesive layer 5 may cover at least a portion of the foot touching surface 4. An illustration of the adhesive layer 5 is shown in FIG. 1, where the adhesive layer partially covers the foot touching surface 4 of the base member 2, and the adhesive layer 5 generally conforms to the shape of the sole protector 1. In an alternative embodiment, the adhesive layer 5 may cover the entire foot touching surface 4 of the base member 2. In yet another embodiment, the adhesive layer may cover only a limited portion of the foot touching surface 4 of the base member 2.

The adhesive layer 5 may be a temporary, pressure sensitive, low tack adhesive. In one embodiment, the adhesive layer 5 may consist only of a satisfactory amount of adhesive such that the adhesive provides adequate shear strength to prevent the sole protector 1 from easily separating from the bottom of a dry foot, stocking, shoe, or other footwear. In another embodiment, the adhesive layer 5 may have a higher shear strength and a higher moisture resistance such that the sole protector 1 adheres to the bottom of a wet shoe sole. In both embodiments, the adhesive layer 5 is sufficiently weak to enable easy removal from the bottom of the foot, stocking, shoe, or other footwear without damaging the foot, stocking, shoe, or other footwear.

A plurality of sole protectors 11 may be detachably secured together in a tablet 6 for convenient dispensing. FIG. 2 shows one embodiment of the tablet 6. In this embodiment, the sole protectors 1 may be stacked vertically such that the toe portion 7 of the top sole protector 9 corresponds to the toe portion 7 of the second sole protector 10. The remaining sole protectors 1 in the plurality of sole protectors 11 may be stacked in the same fashion. The foot touching surface 4 of the top sole protector 9 may adhere to the ground touching surface 3 of the second sole protector 10 by means of the adhesive layer 5. It should be appreciated that each of the sole protectors 1 in the plurality of sole protectors 11 may be secured to one another in the same fashion.

If the base member 2 is composed of plastic material, it may be statically charged to thereby temporarily adhere to the bottom of a bare foot, stocking, or footwear.

Figure 3:
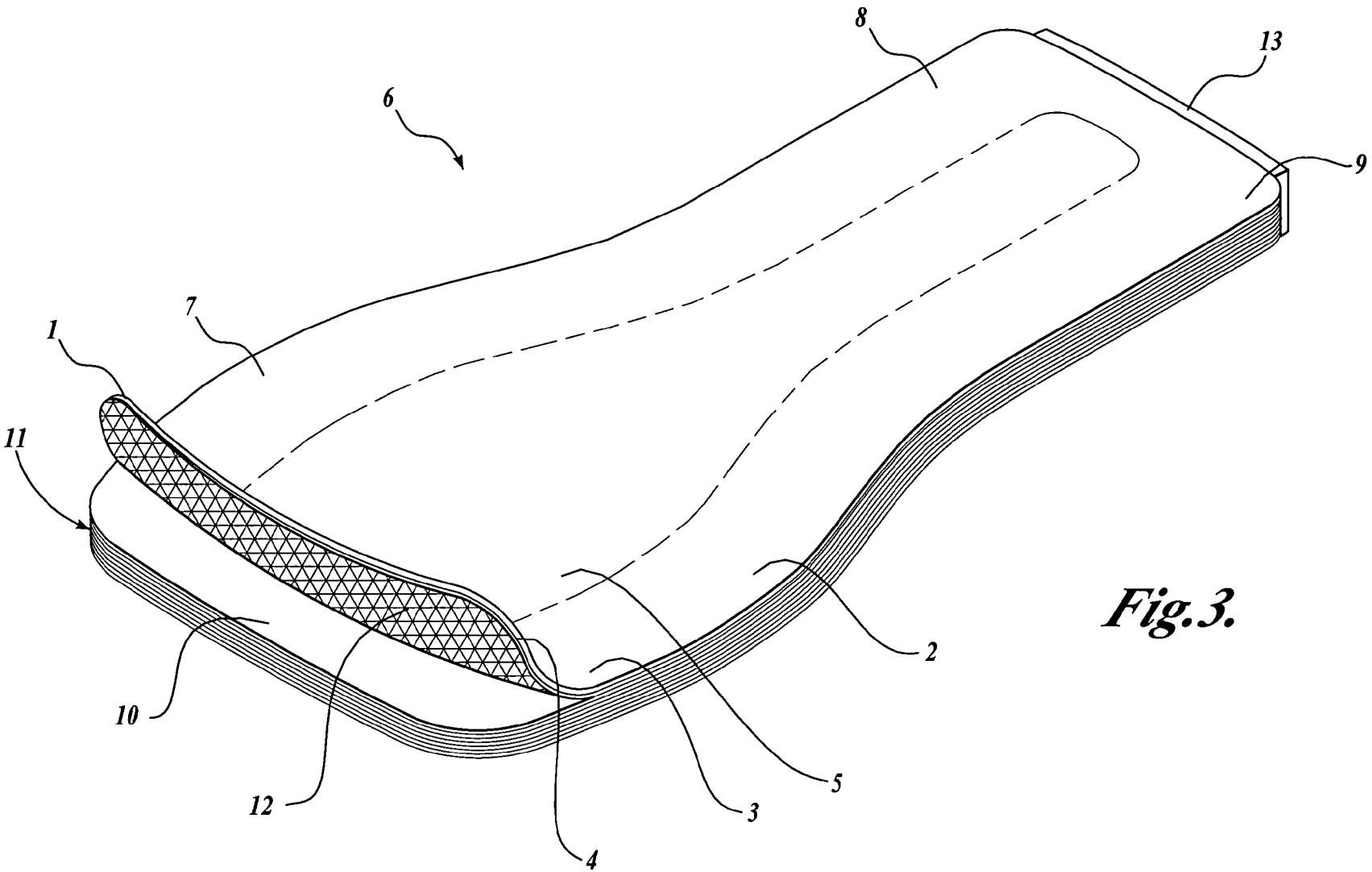
FIG. 3 is a perspective view of another embodiment of the tablet.

Another embodiment of the tablet 6 is shown in FIG. 3. In this alternative embodiment, each sole protector 1 may include a peel sheet 12 to cover the adhesive layer 5. The peel sheet 12 may be fabricated from a paper material that will peel easily from the adhesive layer 5, such as wax paper. The peel sheet 12 can act to prevent the adhesive layer 5 of the top sole protector from adhering to ground touching surface 3 of the second sole protector 10. A peel sheet 12 may be employed on all the sole protectors 1 in the plurality of sole protectors 11 in the tablet 6. The plurality of sole protectors 11 may be stacked vertically, and a tablet edge 13 may secure the plurality of sole protectors 11 to one another. Thus, to dispense the top sole protector 9, the user may tear the top sole protector 9 from the binding tablet edge 13. The user can then remove the peel sheet 12 to adhere the sole protector to the bottom of the foot, shoe, or stocking. Each sole protector 1 may be dispensed for use in the same manner.

Figure 4:
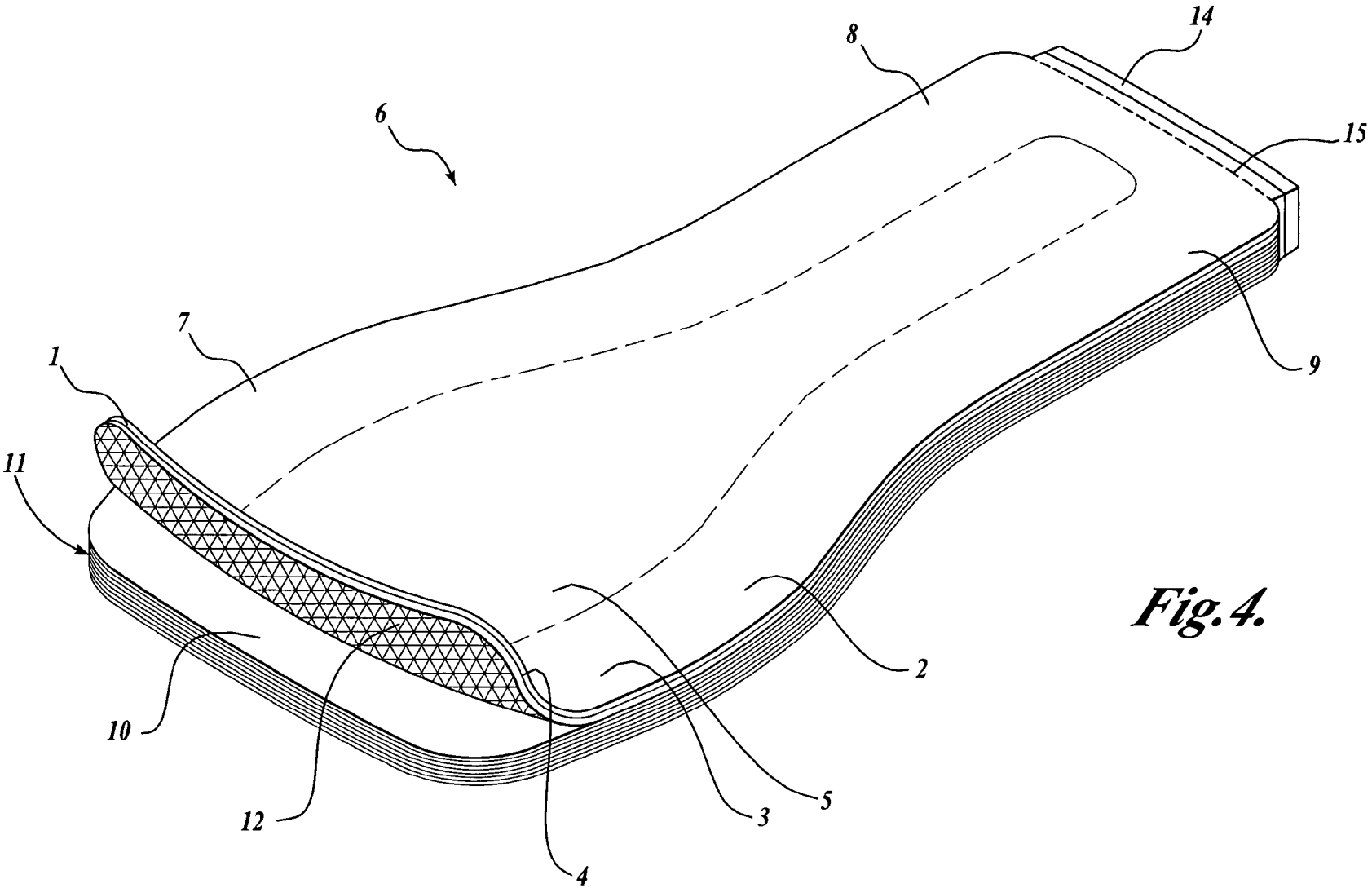
FIG. 4 is a perspective view of yet another embodiment of the tablet.

FIG. 4 shows yet another embodiment of the tablet 6. In this alternative embodiment, each sole protector 1 may include a peel sheet 12 to cover the adhesive layer 5. A peel sheet 12 can be employed on all the sole protectors 1 in the plurality of sole protectors 11 in the tablet 6. The plurality of sole protectors 11 may be stacked vertically and may be secured by a binding tablet edge 14. The sole protector 1 may have a perforated edge 15 so that the sole protector can be torn away from the binding tablet edge 14 when the sole protector is ready to be used. Rather than using a peel sheet 12, a low tack adhesive layer 5 can be used so that the foot touching surface 4 of the top sole protector 9 adheres to the ground touching surface 3 of the second sole protector 10.

While the preferred embodiment of the invention has been illustrated and described, it will be appreciated that various changes can be made therein without departing from the spirit and scope of the invention, including forming the base member 2 in shapes other than as illustrated.

In another variation of the present invention, the base members may be wound in a roll rather than in the tablet format shown in FIGS. 1-4. In such a roll, the base members may be mounted on a peel sheet similar to peel sheet 12 shown in FIG. 3, but with the peel sheet in a continuous roll. In this manner, the base member may simply be peeled off from the peel sheet. As a further embodiment, the base members may be attached to each other end-to-end, with a perforation line separating adjacent base members, perhaps similar to perforation line 15 shown in FIG. 4.

As a further embodiment to the present invention, the base members may be composed of plastic material, with the base members disposed end-to-end and wound in a roll, perhaps similar to plastic produce bags at a grocery store. The base members may be attached to each other by a perforated line, such as line 15 shown in FIG. 4. Moreover, the plastic material base members may inherently adhere to a foot, stocking, shoe, or other type of footwear simply by static electricity associated with the plastic material. Further, an electrostatic charge may be applied to the base member as the base member is being detached from the roll of base members by a static electricity generator, which are well known in the art. In this manner, it may not be necessary to apply an adhesive to the base member to enable the base member to adequately adhere to the user's foot, stocking, shoe or other type of footwear.

The embodiments of the invention in which an exclusive property or privilege is claimed are defined as follows:

1. A sole protector tablet, consisting of:

(a) a plurality of sole protectors nominally stacked directly on top of each other, each sole protector including a base member defining a ground touching surface and an opposing foot touching surface that would be in contact with a foot during use, said base member having a toe portion and a heel portion; and (b) a pressure sensitive, low tack adhesive layer applied directly to substantially the entire area of the foot touching surface of the base member such that substantially the entire area of the foot touching surface is releasably adhered directly to the ground touching surface of an adjacent base member, wherein the pressure senstive, low tack adhesive layer:

(i) provides sufficient strength to temporarily secure adjacent base members together yet allows a foot touching surface of a base member to detach from the ground touching surface of adjacent base member without damaging the base members; and (ii) provides sufficient strength to prevent the sole protector from separating from the bottom of a foot or stocking during walking short distances yet detaches from the bottom of a foot or stocking without damaging the foot or stocking.

2. The sole protector tablet in claim 1, wherein the base member has a shape that substantially corresponds to a left foot superimposed on a right foot.

3. The sole protector tablet as recited in claim 1, wherein the base member is fabricated from paper.

4. The sole protector tablet as recited in claim 1, wherein the base member is fabricated from fabric.

5. The sole protector tablet as recited in claim 1, wherein the base member is fabricated from a biodegradable material.

6. The sole protector tablet as recited in claim 1, wherein the base member is water resistant and varying in color.

7. The sole protector tablet as recited in claim 1, wherein the ground touching surface of the base member acts as a non-skid surface.

8. The sole protector tablet as recited in claim 1, wherein text and/or graphics are imprinted on the base member.

9. The sole protector tablet as recited in claim 8, wherein the text and/or graphics constitutes advertising materials.

10. The sole protector tablet as recited in claim 1, wherein the base member is fabricated from plastic material.

11. The sole protector tablet as recited in claim 1, wherein the base member is electrostatically charged.

12. A sole protector tablet, consisting of:

(a) a plurality of sole protectors nominally stacked directly on top of each other, each sole protector including a base member defining a ground touching surface and an opposing foot touching surface that would be in contact with a foot during use, said base member having a toe portion and a heel portion; and (b) a pressure sensitive, low tack adhesive layer applied directly to substantially the entire area of the foot touching surface of the base member such that substantially the entire area of the foot touching surface is releasably adhered directly to the ground touching surface of an adjacent base member.

13. The sole protector tablet in claim 12, wherein the base member has a shape that substantially corresponds to a left foot superimposed on a right foot.

14. The sole protector tablet as recited in claim 12, wherein the base member is fabricated from paper.

15. The sole protector tablet as recited in claim 12, wherein the base member is fabricated from fabric.

16. The sole protector tablet as recited in claim 12, wherein the base member is fabricated from a biodegradable material.

17. The sole protector tablet as recited in claim 12, wherein the base member is water resistant and varying in color.

18. The sole protector tablet as recited in claim 12, wherein the ground touching surface of the base member acts as a non-skid surface.

19. The sole protector tablet as recited in claim 12, wherein the base member is fabricated from plastic material.

20. The sole protector tablet as recited in claim 12, wherein the base member is electrostatically charged.

* * * * *